US010274191B2

(12) United States Patent
Li et al.

(10) Patent No.: US 10,274,191 B2
(45) Date of Patent: Apr. 30, 2019

(54) VENTILATION ILLUMINATION DEVICE

(71) Applicants: Panasonic Ecology Systems Guangdong Co., Ltd., Foshan, Guangdong (CN); Panasonic Corporation, Osaka (JP)

(72) Inventors: Gangyi Li, Guangdong (CN); Bodong Zhong, Guangdong (CN); Guancheng Hou, Guangdong (CN); Daisuke Tsubosa, Aichi (JP)

(73) Assignees: PANASONIC ECOLOGY SYSTEMS GUANGDONG CO., LTD. (CN); PANASONIC CORPORATION (JP)

( * ) Notice: Subject to any disclaimer, the term of this patent is extended or adjusted under 35 U.S.C. 154(b) by 206 days.

(21) Appl. No.: 14/914,903

(22) PCT Filed: Nov. 10, 2014

(86) PCT No.: PCT/CN2014/090691
§ 371 (c)(1),
(2) Date: Feb. 26, 2016

(87) PCT Pub. No.: WO2015/078292
PCT Pub. Date: Jun. 4, 2015

(65) Prior Publication Data

US 2016/0312996 A1 Oct. 27, 2016

(30) Foreign Application Priority Data

Nov. 29, 2013 (CN) ..... 2013 2 0777604 U

(51) Int. Cl.
*F21K 9/23* (2016.01)
*F21V 19/00* (2006.01)
(Continued)

(52) U.S. Cl.
CPC ..... *F21V 33/0096* (2013.01); *F21V 19/006* (2013.01); *F21V 19/007* (2013.01);
(Continued)

(58) Field of Classification Search
CPC ..... F21V 25/00; F21V 17/005; F21V 19/006; F21V 19/0065; F21K 9/23; H01R 33/97; H01R 33/973
See application file for complete search history.

(56) References Cited

U.S. PATENT DOCUMENTS 5,422,487 A * 6/1995 Sauska ..... C02F 1/325 250/436
5,575,459 A * 11/1996 Anderson ..... H05B 33/0809 313/318.03
(Continued)

FOREIGN PATENT DOCUMENTS

CN 201152270 11/2008
CN 201627758 11/2010
(Continued)

OTHER PUBLICATIONS

International Search Report and Written Opinion issued in related International Application No. PCT/CN2014/090691, dated Jan. 13, 2015.

*Primary Examiner* — Alexander K Garlen
*Assistant Examiner* — Colin J Cattanach
(74) *Attorney, Agent, or Firm* — RatnerPrestia

(57) ABSTRACT

A ventilator illumination device, including a light-emitting module for housing a light-emitting unit and a power box module for housing a power supply supplying direct current for the light-emitting unit, wherein an anti-reversal installation structure is provided on the light-emitting module and the power box module, the anti-reversal installation structure limiting the light-emitting unit to be installed only in a state that the light-emitting unit faces towards one prede-
(Continued)

termined direction. The illumination device is easy to install and prevents inversion of the light-emitting unit, thus ensuring proper brightness of the light irradiated by the light-emitting unit into the room.

10 Claims, 9 Drawing Sheets

(51) Int. Cl.

| | |
|---|---|
| ***F21V 19/06*** | (2006.01) |
| ***F21V 23/00*** | (2015.01) |
| ***F24F 7/02*** | (2006.01) |
| ***F21V 33/00*** | (2006.01) |
| ***F24F 13/14*** | (2006.01) |
| ***F24F 13/078*** | (2006.01) |

(52) U.S. Cl.
CPC ..... *F21V 19/0065* (2013.01); *F21V 23/008* (2013.01); *F24F 7/02* (2013.01); *F24F 13/078* (2013.01); *F24F 13/14* (2013.01); *F21K 9/23* (2016.08); *F21V 19/06* (2013.01)

(56) References Cited

U.S. PATENT DOCUMENTS 5,934,783 A 8/1999 Yoshikawa
7,347,706 B1 * 3/2008 Wu ..... H01R 13/7175 430/642
7,491,077 B1 * 2/2009 Yang ..... F21V 19/006 439/241
8,040,032 B2 * 10/2011 Kovacs ..... H01R 33/0809 313/318.01
8,403,509 B2 * 3/2013 Chin ..... F21V 14/02 362/249.02
8,657,470 B2 * 2/2014 Jen ..... F21K 9/65 362/249.07
8,845,132 B2 * 9/2014 Flaherty ..... H05B 33/0803 362/249.03
9,040,947 B2 * 5/2015 Trewin ..... H02J 50/10 250/551
9,169,982 B2 * 10/2015 Hsieh ..... F21K 9/58
2002/0018344 A1 * 2/2002 Sears, Jr. ..... H01R 29/00 362/265
2003/0189828 A1 * 10/2003 Coushaine ..... F21V 29/76 362/656
2008/0227320 A1 * 9/2008 Witham ..... F21V 19/008 439/227
2009/0045715 A1 * 2/2009 Shantha ..... H01J 5/54 313/51
2009/0262535 A1 * 10/2009 Maillet-Jegou ..... A01M 1/145 362/253
2011/0141766 A1 * 6/2011 Chang ..... G02B 6/0006 362/608
2012/0236602 A1 * 9/2012 Flaherty ..... H05B 33/0803 362/650
2012/0307524 A1 * 12/2012 Schapira ..... H01R 13/7175 362/652
2012/0314414 A1 * 12/2012 Flaherty ..... H05B 33/0803 362/249.02
2014/0218923 A1 * 8/2014 Chi ..... F21K 9/23 362/249.03
2014/0286020 A1 * 9/2014 Tsai ..... F21K 9/1355 362/363
2014/0328066 A1 * 11/2014 Barnetson ..... F21V 3/0436 362/294

FOREIGN PATENT DOCUMENTS

CN 202092268 12/2011
CN 203686751 7/2014
DE 19625673 A1 * 1/1997 ..... F21V 19/0095
EP 1348902 A1 * 10/2003 ..... F21V 19/0095
FR 2834546 A1 * 7/2003 ..... F21S 8/033
WO WO 2014161102 A1 * 10/2014 ..... F21V 23/02

* cited by examiner

VENTILATION ILLUMINATION DEVICE

CROSS-REFERENCE TO RELATED APPLICATIONS

This application is a Section 371 National Stage Application of International Application No. PCT/CN2014/090691, filed Nov. 10, 2014, entitled "VENTILATOR ILLUMINATION DEVICE", which claims priority to Chinese Application No. 201320777604.8, filed on Nov. 29, 2013, incorporated herein by reference in their entirety.

BACKGROUND OF THE INVENTION

Field of the Invention

The present disclosure relates to a ventilator, and specifically relates to a ventilator illumination device.

Description of the Related Art

A ventilator (exhaust fan), which is installed between a roof and a ceiling, is a common ventilation equipment. In order for a ventilator with an illumination function, an illumination device may be provided on a louver of the ventilator. U.S. Pat. No. 5,934,783 discloses a ventilator with an illumination function, as shown in FIG. 1, there is an opening 1 provided in a bottom surface of a frame 5, in which a blower 3is provided. A louver 15 is provided at the opening 1, an illumination device 25 covering the opening 1 is provided in the center of the louver 15, and an illumination socket 8 is fixed onto the illumination device 25. Also, a freely detachable fluorescent lamp 7 is mounted into the illumination socket 8. An illumination cover 14, which may be freely detached from the louver 15, is provided in the center of the louver 15.

It is sufficient for a user to fix the illumination cover 14 after the fluorescent lamp 7 being inserted into the illumination socket 8 when the user wants to fix the fluorescent lamp 7. Since a lamp tube for the fluorescent lamp 7 emits light in all directions, the light emitted by the fluorescent lamp 7 may be directly irradiated into a room through the illumination cover 14, no matter in which direction the fluorescent lamp 7 is inserted into the illumination socket 8.

Except for the above described fluorescent lamp which may emit light in all directions, there are some light-emitting units, which work in one-sided illumination, for example, in the case where LED chips are arranged on one of surfaces of an LED lamp tube by a designer, when the user wants to fix the LED lamp, if the LED lamp is installed reversely, namely, the LED lamp is inserted into the socket in a state that the surface provided with the LED chips faces upward and the surface not provided with the LED chips faces downward, then the light emitted from the LED chips would be irradiated upward to a reflector, reflected back to the illumination cover, and then irradiated into the room. As a result, the light irradiated into the room from the LED lamp is greatly reduced in brightness.

SUMMARY OF THE INVENTION

An objective of the present disclosure is to provide a ventilator illumination device, which can prevent the light-emitting units from being installed reversely.

To achieve the above objective, there is provided a ventilator illumination device, comprising a light-emitting module for housing a light-emitting unit and a power box module for housing a power supply supplying direct current for the light-emitting unit, wherein an anti-reversal installation structure is provided on the light-emitting module and the power box module, the anti-reversal installation structure limiting the light-emitting unit to be installed only in a state that the light-emitting unit faces towards one predetermined direction.

The light-emitting unit includes a lamp holder, a lamp tube and light-emitting chips arranged on one surface of the lamp tube, and the power box module comprises a power box body and a socket provided in the power box body for insertion of the lamp holder of the light-emitting unit; the anti-reversal installation structure comprises a half-circle flange provided on the lamp holder of the light-emitting unit near to the lamp tube and protruding lugs provided on one surface of the power box body near to the light-emitting module.

The flange is located at the bottom of the lamp holder of the light-emitting unit, the protruding lugs are provided at the top of the power box body, and a projection of the protruding lugs in a horizontal projection plane extends over a projection of the power box body in the horizontal projection plane.

The flange is located at the top of the lamp holder of the light-emitting unit, the protruding lugs are provided at the bottom of the power box body, and a projection of the protruding lugs in a horizontal projection plane extends over a projection of the power box body in the horizontal projection plane.

A positioning plate, which extends towards the light-emitting module over a distance shorter than the protruding lugs, is provided on the bottom of the one surface of the power box body near to the light-emitting module, and a gap is kept between the positioning plate and the flange of the lamp holder of the light-emitting unit when the lamp holder of the light-emitting unit is inserted into the socket.

The light-emitting unit includes a lamp holder, a lamp tube and light-emitting chips arranged on one surface of the lamp tube, and the power box module comprises a power box body and a socket provided in the power box body for insertion of the lamp holder of the light-emitting unit; the anti-reversal installation structure comprises a protrusion provided on a surface of the lamp holder of the light-emitting unit opposite to the socket and a recess or opening provided in the socket and configured to correspond to the protrusion.

The light-emitting unit includes a lamp holder, a lamp tube and light-emitting chips arranged on one surface of the lamp tube, and the power box module comprises a power box body and a socket provided in the power box body for insertion of the lamp holder of the light-emitting unit; the anti-reversal installation structure comprises a recess or opening provided in a surface of the lamp holder of the light-emitting unit opposite to the socket and a protrusion provided on the socket and configured to be snapped into the recess or opening.

The flange is formed in a discontinuous form.

According to the present disclosure, the illumination device is easy to install and prevents inversion of the light-emitting unit, thus ensuring proper brightness of the light irradiated by the light-emitting unit into the room.

DETAILED DESCRIPTION OF PREFERRED EMBODIMENTS OF THE INVENTION

Figure 1:
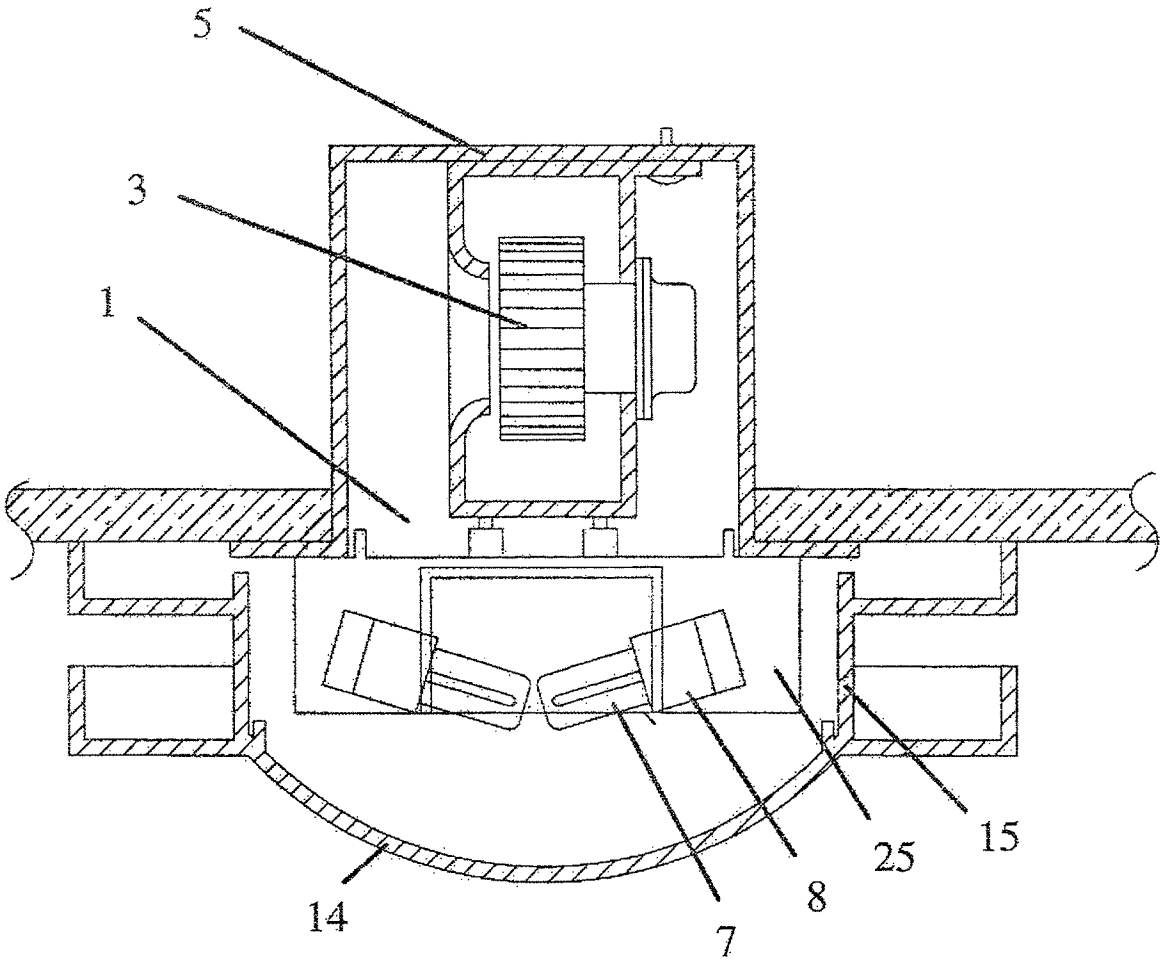
Fig. 1 ( Prior Art )
FIG. 1 is a schematic view of a ventilator in the prior art.
Figure 2A:
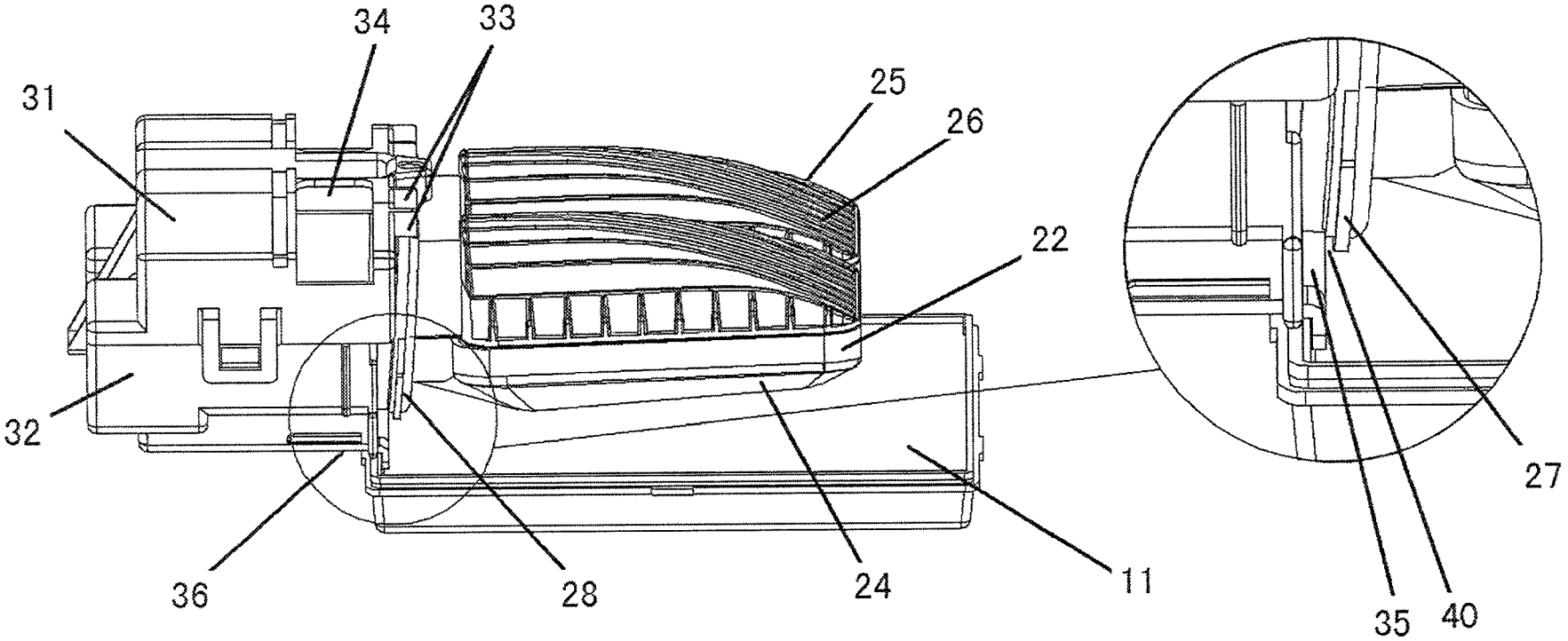
FIG. 2A is a perspective schematic view of a ventilator according to the first embodiment of the present invention.
Figure 2B:
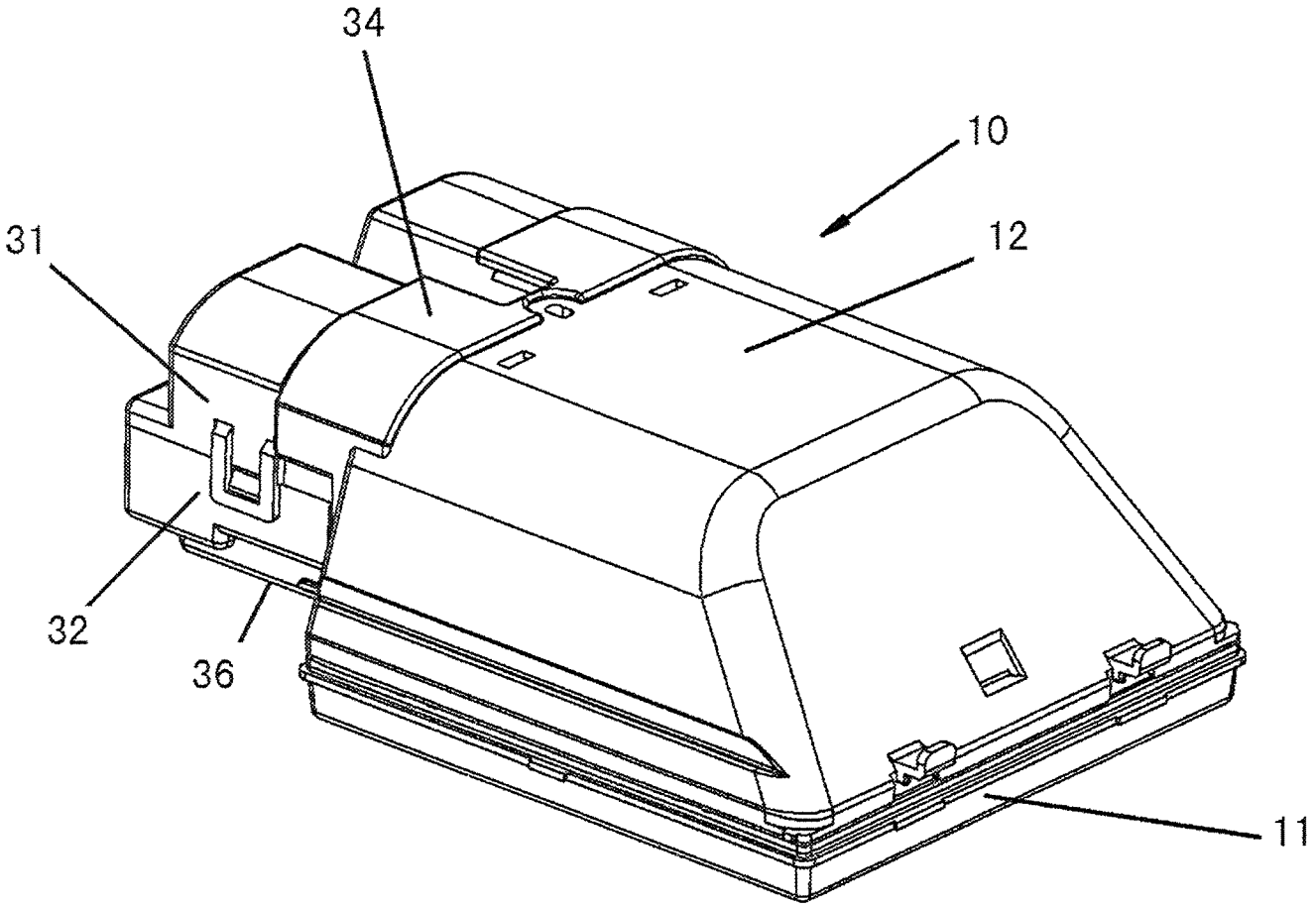
FIG. 2B is a perspective schematic view of the ventilator according to the first embodiment of the present invention in another view.
Figure 3A:
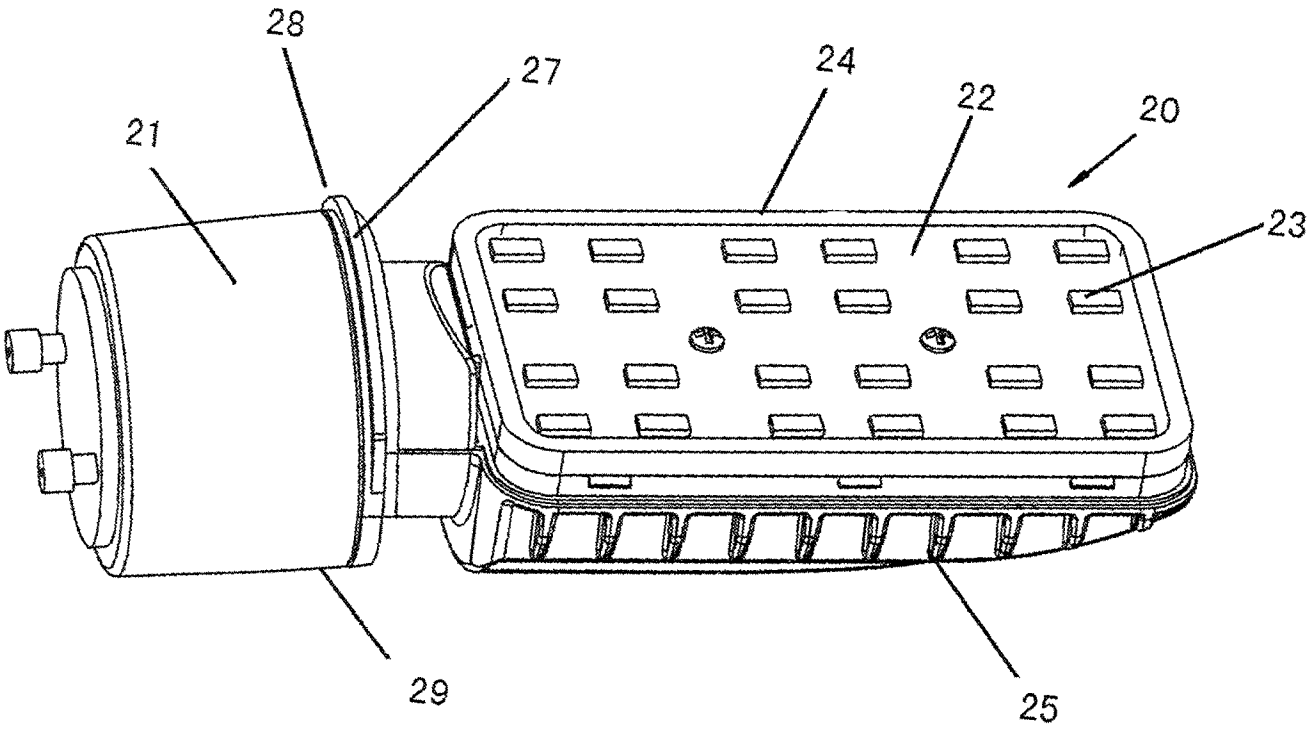
FIG. 3A is a perspective schematic view of a light-emitting unit in the first embodiment of the present invention.
Figure 3B:
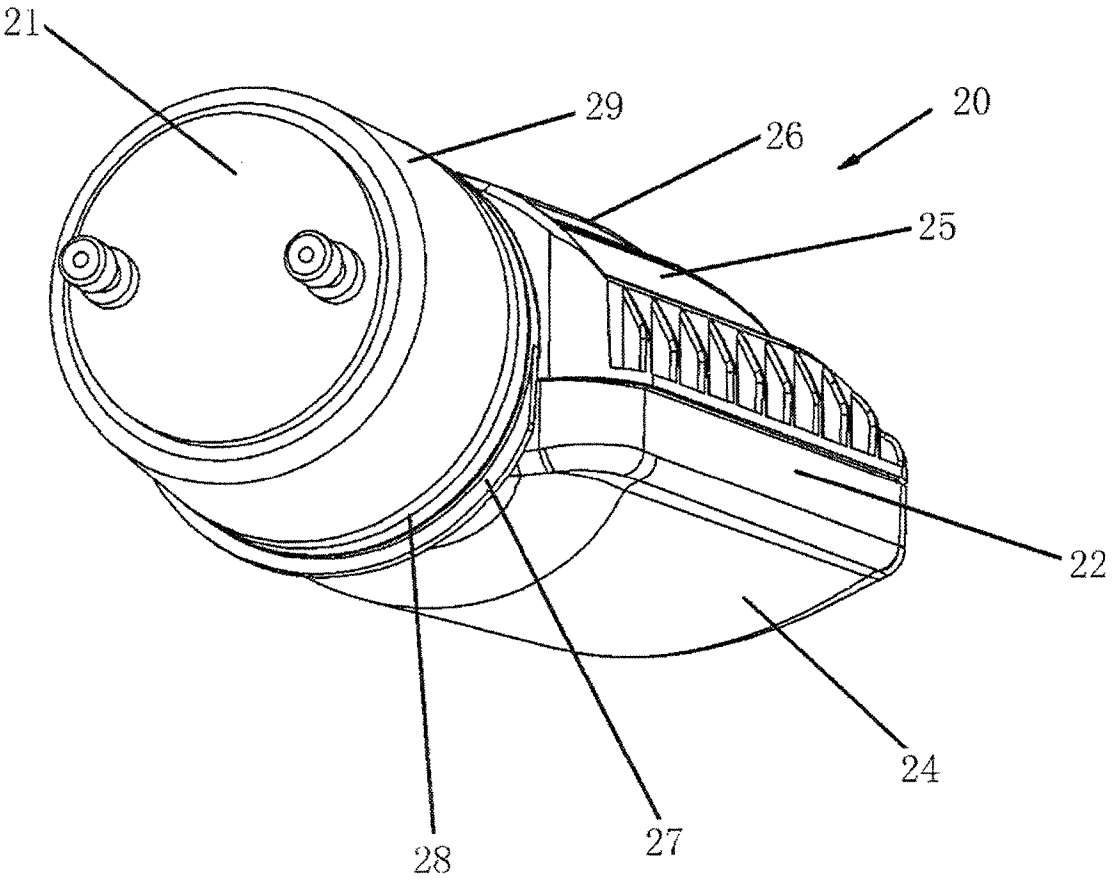
FIG. 3B is a perspective schematic view of the light-emitting unit in the first embodiment of the present invention in another view.

FIGS. 2A and 2B are perspective schematic views of a ventilator according to the first embodiment of the present invention in different views; and FIGS. 3A and 3B are perspective schematic views of a light-emitting unit in the first embodiment of the present invention in different views.

As shown in the Figures, the ventilator illumination device 10 in the present disclosure comprises a light-emitting module having an illumination louver 11 and a reflective cover 12 for housing a light-emitting unit 20 and a power box module for housing a power supply supplying direct current for the light-emitting unit 20, wherein an anti-reversal installation structure is provided on the light-emitting module and the power box module, the anti-reversal installation structure limiting the light-emitting unit 20 to be installed only in a state that the light-emitting unit 20 faces towards one predetermined direction.

The light-emitting unit 20 consists of a lamp holder 21, a lamp tube 22 and light-emitting chips 23 arranged on one surface of the lamp tube 22. In the present disclosure, an LED lamp is taken as an example to illustrate, that is, the light-emitting unit 20 is an LED lamp, consisting of a lamp holder 21, a lamp tube 22 and LED light-emitting chips 23 arranged on one surface of the lamp tube 22.

The power box module comprises a power box body 31 and a socket 32 provided in the power box body 31 for insertion of the lamp holder 21 of the LED lamp; the power box module is fixed onto the light-emitting module, and supplies power for the above LED lamp via a cable, so as to form an illumination device.

The LED light-emitting chips 23 are arranged on a bottom surface 24 of the LED lamp, a plurality of radiation ribs 26 parallel to each other may be provided on a top surface 25 of the LED lamp opposite to the bottom surface 24 of the LED lamp for arranging the LED light-emitting chips 23.

By means of the anti-reversal installation structure provided on the light-emitting module and the power box module for enabling the LED lamp to be installed only in a state that the bottom surface 24 of the LED lamp faces to the illumination louver 11, the lamp holder 21 can be inserted into the socket 32 of the power box module only in a state that the bottom surface 24 of the LED lamp faces to the illumination louver 11 when a user wants to fix the LED lamp.

Thus, it ensures that the bottom surface 24 of the LED lamp faces to the illumination louver 11 after the LED lamp is installed on the power box module, thereby the light emitted by the LED light-emitting chips 23 being directly irradiated into a room through the illumination louver 11.

In the embodiment, the anti-reversal installation structure comprises a half-circle flange 27 provided on the lamp holder 21 of the light-emitting unit 20 near to the lamp tube 22 and protruding lugs 33 provided on one surface of the power box body 31 near to the light-emitting module.

The flange 27 is located at the bottom 28 of the lamp holder 21 of the light-emitting unit 20, the protruding lugs 33 are provided at the top 34 of the power box body 31, and a projection of the protruding lugs 33 in a horizontal projection plane extends over a projection of the power box body 31 in the horizontal projection plane.

In the present disclosure, a lower half-circle of the lamp holder 21 corresponding to the bottom surface 24 of the LED lamp is referred to as the bottom 28 of the lamp holder 21, and an upper half-circle of the lamp holder 21 corresponding to the top surface 25 of the LED lamp is referred to as the top 29 of the lamp holder 21. In other words, one side of the lamp holder 21 facing to the illumination louver 11 is referred to as the bottom 28 of the lamp holder 21, and the other side of the lamp holder 21 facing to a roof is referred to as the top 29 of the lamp holder 21.

If the half-circle flange 27 is provided at the bottom 28 of the lamp holder 21, then the protruding lugs 33 are provided at the top 34 of the power box body 31, and a projection of the protruding lugs 33 in a horizontal projection plane extends over a projection of the power box body 31 in the horizontal projection plane (i.e., the protruding lugs 33 extend to the reflective cover 12 of the light-emitting module when the light-emitting module is connected to the power box body 31).

When the user fixes the LED lamp, if the bottom surface 24 of the LED lamp faces to the roof, the flange 27 provided at the bottom 28 of the lamp holder 21 will meet the protruding lugs 33 provided at the top 34 of the power box body 31, as a result, the lamp holder 21 cannot continue to be inserted into the socket 32 within the power box body 31.

Thus, only if the user makes the bottom surface 24 of the LED lamp face downward (i.e., face to the illumination louver 11), the flange 27 provided at the bottom 28 of the lamp holder 21 will not meet the protruding lugs 33 provided at the top 34 of the power box body 31, thereby the lamp holder 21 may be inserted into the socket 32 within the power box body 31.

A positioning plate 35, which extends towards the light-emitting module over a distance shorter than the protruding lugs 33, is provided on the bottom 36 of the one surface of the power box body 31 near to the light-emitting module, and a gap 40 is kept between the positioning plate 35 and the flange 27 of the lamp holder 21 of the light-emitting unit 20 when the lamp holder 21 of the light-emitting unit 20 is inserted into the socket 32.

The positioning plate 35 may support a part of weight of the lamp holder 21, and both the positioning plate 35 provided on the bottom 36 of the power box body 31 and the protruding lugs 33 provided at the top 34 of the power box body 31 hold the lamp holder 21 and therefore the LED lamp. As a result, it prevents a tail of the lamp tube 22 from slightly falling to be excessively close to the illumination louver 11 due to a relatively large weight of the lamp tube 22, which will cause a significant difference of the light reflected to the illumination louver 11 in brightness (i.e., the light irradiated to the illumination louver 11 of the lamp tube 22 away from the lamp holder 21 of the LED lamp is brighter than that of the lamp tube 22 adjacent to the lamp holder 21).

Furthermore, since there is a gap 40 kept between the positioning plate 35 and the flange 27 of the lamp holder 21 of the LED lamp when the lamp holder 21 of the LED lamp is inserted into the socket 32, the flange 27 will not meet the positioning plate 35 during installation of the LED lamp, that is to say, the positioning plate 35 will not interfere with the installation of the LED lamp.

Thereby, such a structure may prevent the light-emitting unit from being installed reversely, and maintain the brightness of the light of the light-emitting unit irradiated into the room and the uniformity of the light irradiated into the illumination louver, thereby improving the appearance.

Figure 4:
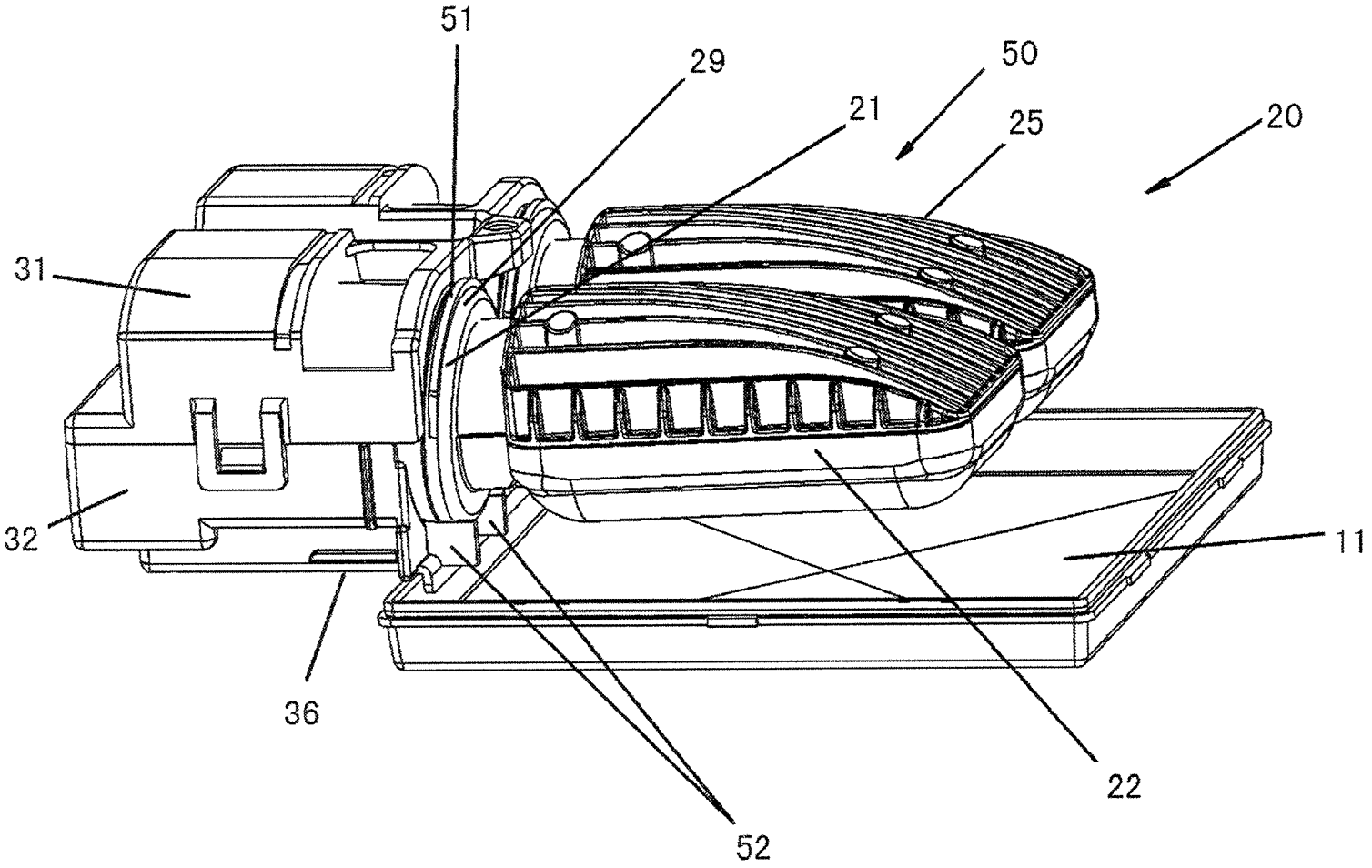
FIG. 4 is a schematic view of a ventilator according to the second embodiment of the present invention.

FIG. 4 is a schematic view of a ventilator according to the second embodiment of the present invention. As for the ventilator illumination device 50 according to the present embodiment, as shown in the Figure, it differs from the first embodiment in that a flange 51 is located at the top 29 of the lamp holder 21 of the light-emitting unit 20, protruding lugs 52 are provided at the bottom 36 of the power box body 31, and a projection of the protruding lugs 52 in a horizontal projection plane extends over a projection of the power box body 31 in the horizontal projection plane (i.e., the protruding lugs 52 extend to the illumination louver 11 of the light-emitting module when the light-emitting module is connected to the power box body 31).

When the user fixes the LED lamp, if the bottom surface 24 of the LED lamp faces upward, the flange 51 provided at the top 29 of the lamp holder 21 will meet the protruding lugs 52 provided at the bottom 36 of the power box body 31, as a result, the lamp holder 21 cannot continue to be inserted into the power box body 31.

Thus, only if the user makes the bottom surface 24 of the LED lamp face downward (i.e., face to the illumination louver 11), the flange 51 provided at the top 29 of the lamp holder 21 will not meet the protruding lugs 52 provided at the bottom 36 of the power box body 31, thereby the lamp holder 21 may be inserted into the socket 32 within the power box body 31.

Further, the protruding lugs 52 extending to the illumination louver 11 of the light-emitting module may support a part of weight of the lamp holder 21, and further hold the LED lamp. As a result, it prevents the tail of the lamp tube 22 from slightly falling to be excessively close to the illumination louver 11 due to a relatively large weight of the lamp tube 22, which will cause a significant difference of the light reflected to the illumination louver 11 in brightness, i.e., the light irradiated to the illumination louver 11 of the lamp tube away from the lamp holder 21 of the LED lamp is brighter than that of the lamp tube adjacent to the lamp holder 21.

Figure 5:
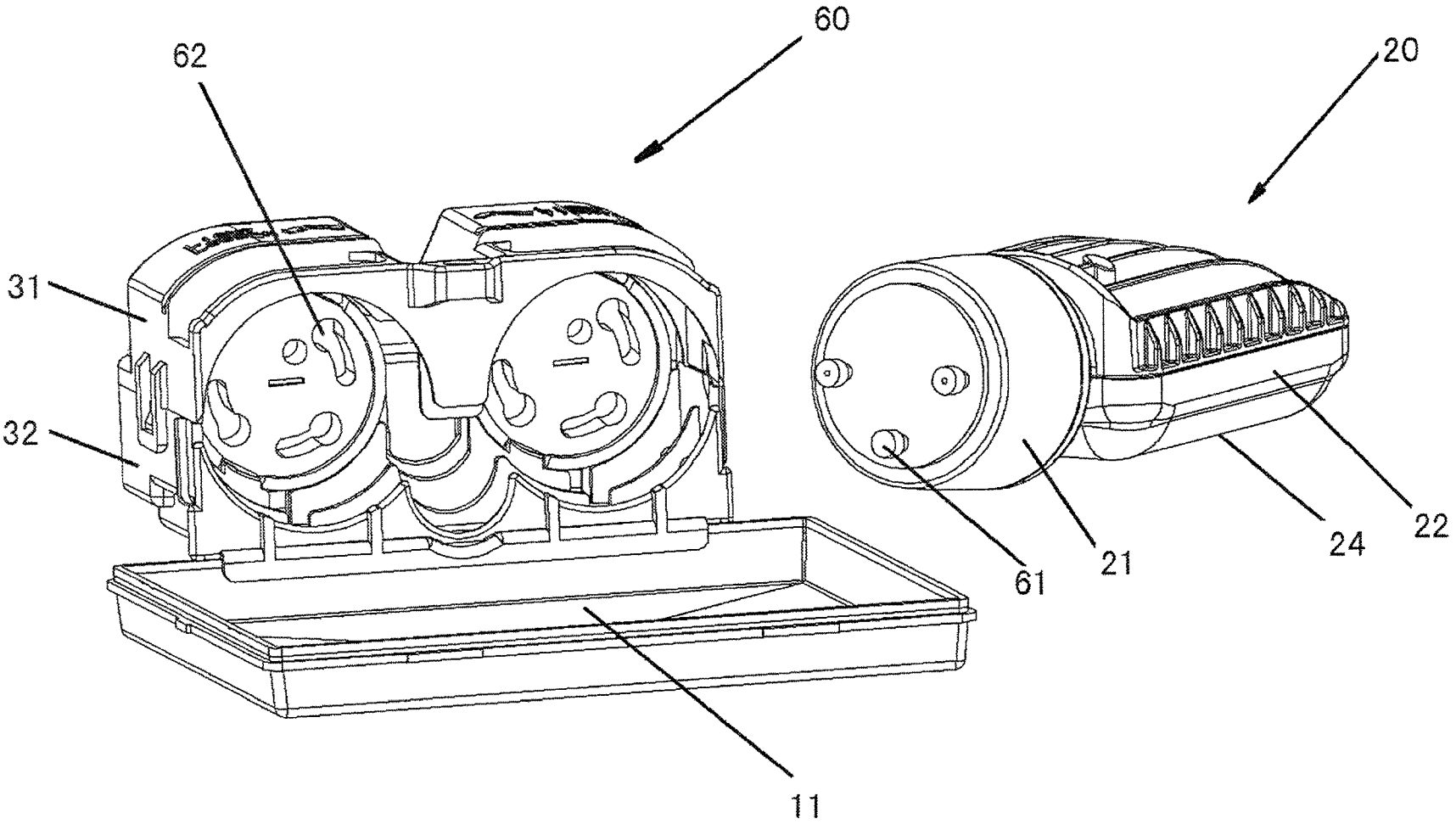
FIG. 5 is a schematic view of a ventilator according to the third embodiment of the present invention.

FIG. 5 is a schematic view of a ventilator according to the third embodiment of the present invention. As for the ventilator illumination device 60 according to the present embodiment, as shown in the Figure, the light-emitting unit 20 consists of a lamp holder 21, a lamp tube 22 and light-emitting chips (not shown) arranged on one surface of the lamp tube 22, and the power box module comprises a power box body 31 and a socket 32 provided in the power box body 31 for insertion of the lamp holder 21 of the light emitting unit 20; the anti-reversal installation structure comprises a protrusion 61 provided on a surface of the lamp holder 21 of the light-emitting unit 20 opposite to the socket 32 and a recess or opening 62 provided in the socket 32 and configured to correspond to the protrusion 61.

When the user fixes the LED lamp, if the bottom surface 24 of the LED lamp faces to the roof, the protrusion 61 of the lamp holder 21 will meet the wall of the socket, as a result, the lamp holder 21 cannot be inserted into the socket 32. Thus, only if the user makes the bottom surface 24 of the LED lamp face downward (i.e., face to the illumination louver 11), the protrusion 61 of the lamp holder 21 will not meet the wall of the socket 32 (a part surrounding the hole of the socket 32), but be inserted into the recess or opening 62, thereby the lamp holder 21 may be inserted into the socket 32 within the power box body 31. In such a way, it may prevent the light-emitting unit 20 from being installed reversely.

Figure 6:
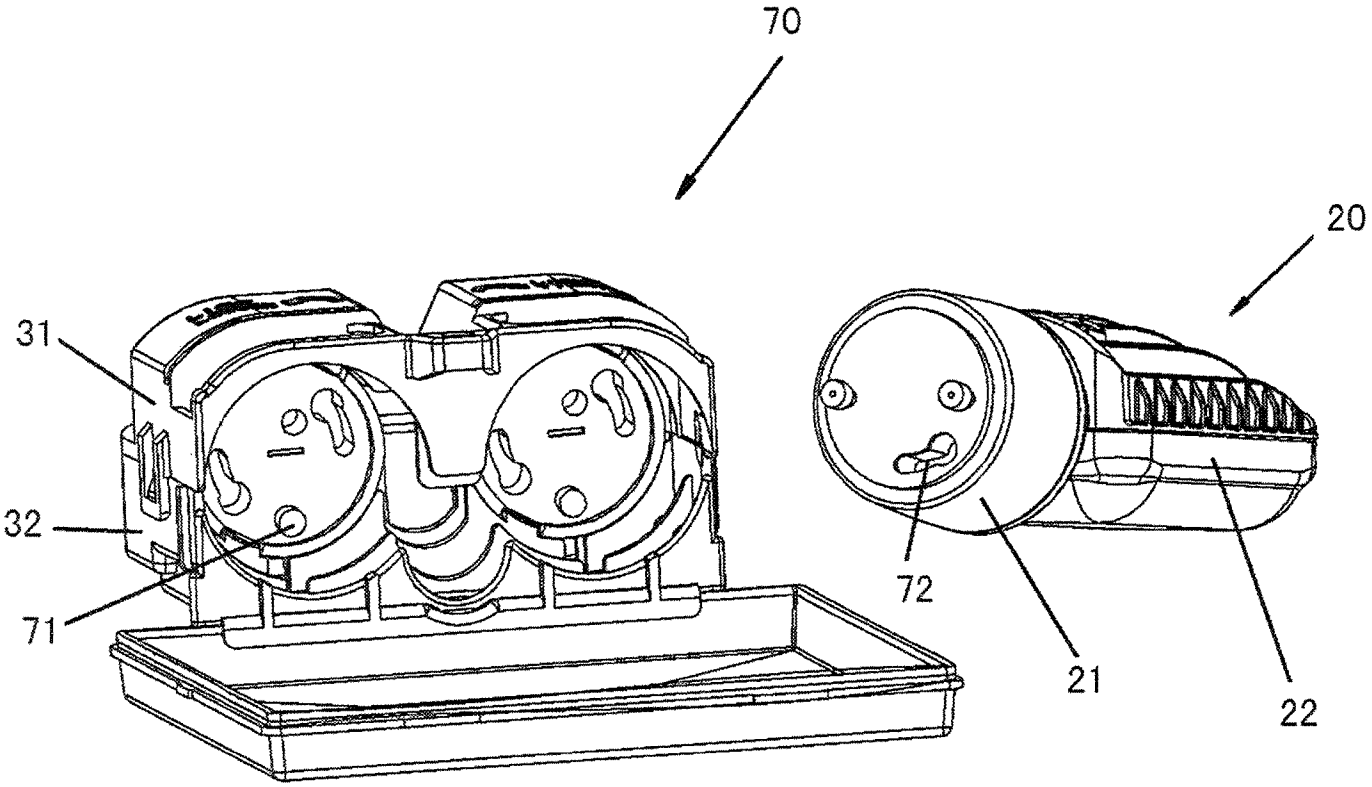
FIG. 6 is a schematic view of a ventilator according to the fourth embodiment of the present invention.

FIG. 6 is a schematic view of a ventilator according to the fourth embodiment of the present invention. As for the ventilator illumination device 70 according to the present embodiment, as shown in the Figure, the light-emitting unit 20 consists of a lamp holder 21, a lamp tube 22 and light-emitting chips (not shown) arranged on one surface of the lamp tube 22, and the power box module comprises a power box body 31 and a socket 32 provided in the power box body 31 for insertion of the lamp holder 21 of the light-emitting unit 20; the anti-reversal installation structure comprises a recess or opening 72 provided in a surface of the lamp holder 21 of the light-emitting unit 20 opposite to the socket 32 and a protrusion 71 provided on the socket 32 and configured to be snapped into the recess or opening 72.

As for installation method, the fourth embodiment of the present invention is similar to the third embodiment, and the operation principle of the fourth embodiment of the present invention is in accordance with the above described contents, which are omitted here.

Figure 7:
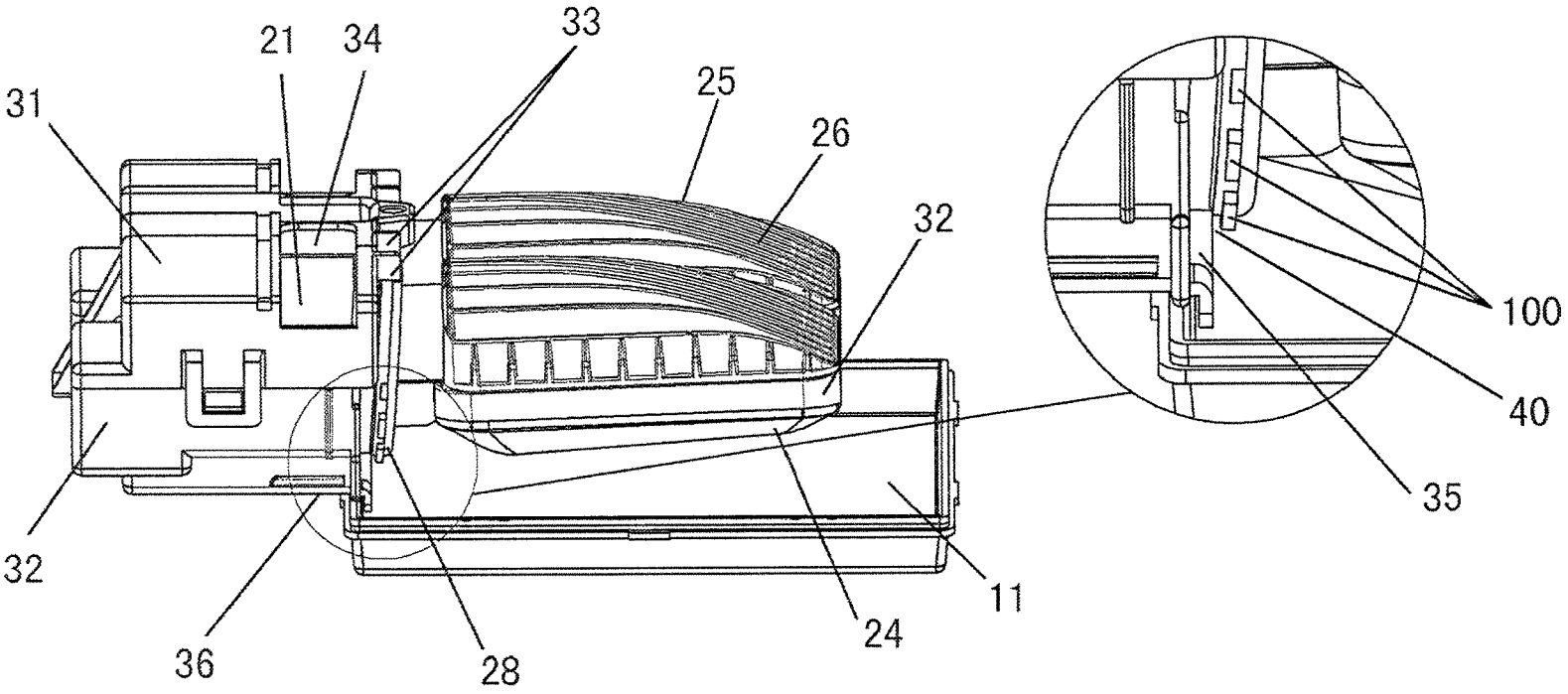
FIG. 7 is a schematic view of a ventilator according to the fifth embodiment of the present invention.

FIG. 7 is a schematic view of a ventilator according to the fifth embodiment of the present invention. As shown in the Figure, a flange 100 is formed in a discontinuous form.

By means of the above structure, when the user fixes the LED lamp, if the bottom surface 24 of the LED lamp faces to the roof, the flange 100 provided at the bottom 28 of the lamp holder 21 will meet the protruding lugs 33 provided at the top 34 of the power box body 31, as a result, the lamp holder 21 cannot continue to be inserted into the socket 32 within the power box body 31.

Thus, only if the user makes the bottom surface 24 of the LED lamp face downward (i.e., face to the illumination louver 11), the flange 100 provided at the bottom 28 of the lamp holder 21 will not meet the protruding lugs 33 provided at the top 34 of the power box body 31, thereby the lamp holder 21 may be inserted into the socket 32 within the power box body 31.

Furthermore, in contrast to the half-circle flange, the flange 100 is formed in a discontinuous form, which will reduce the amount of materials of the flange 100. In other words, the flange 100 can reduce cost with the same function and effect as the half-circle flange.

What is claimed is:

1. A ventilator illumination device, comprising a light-emitting module for housing a light-emitting unit and a power box module for housing a power supply supplying direct current for the light-emitting unit, wherein, an anti-reversal installation structure is provided on the light-emitting module and the power box module, the anti-reversal installation structure limiting the light-emitting unit to be installed only in a state that the light-emitting unit faces towards one predetermined direction, wherein the light-emitting unit includes a lamp holder, a lamp tube and light-emitting chips arranged on one surface of the lamp tube, and the power box module comprises a power box body and a socket provided in the power box body for insertion of the lamp holder of the light-emitting unit;

the anti-reversal installation structure comprises a half-circle flange provided on the lamp holder of the light-emitting unit near to the lamp tube and protruding lugs provided on one surface of the power box body near to the light-emitting module, wherein a positioning element, which extends towards the light-emitting module over a distance shorter than the protruding lugs, is disposed on the bottom of the one surface of the power box body near the light-emitting module, and an empty gap separates the positioning element from the flange of the lamp holder of the light-emitting unit when the lamp holder of the light-emitting unit is inserted into the socket;

wherein both the positioning element and the protruding lugs hold the lamp holder.

2. The ventilator illumination device according to claim 1, wherein the flange is located at the bottom of the lamp holder of the light-emitting unit, the protruding lugs are provided at the top of the power box body, and a projection of the protruding lugs in a horizontal projection plane extends over a projection of the power box body in the horizontal projection plane.

3. The ventilator illumination device according to claim 1, wherein the flange is located at the top of the lamp holder of the light-emitting unit, the protruding lugs are provided at the bottom of the power box body, and a projection of the protruding lugs in a horizontal projection plane extends over a projection of the power box body in the horizontal projection plane.

4. The ventilator illumination device according to claim 1, wherein the anti-reversal installation structure comprises a protrusion provided on a surface of the lamp holder of the light-emitting unit opposite to the socket and a recess or opening provided in the socket and configured to correspond to the protrusion.

5. The ventilator illumination device according to claim 1, wherein the anti-reversal installation structure comprises a recess or opening provided in a surface of the lamp holder of the light-emitting unit opposite to the socket and a protrusion provided on the socket and configured to be snapped into the recess or opening.

6. The ventilator illumination device according to claim 1, wherein the flange is formed in a discontinuous form.

7. The ventilator illumination device according to claim 2, wherein the flange is formed in a discontinuous form.

8. The ventilator illumination device according to claim 3, wherein the flange is formed in a discontinuous form.

9. The ventilator illumination device according to claim 1, wherein the half-circle flange is formed on an exterior surface of the light-emitting module.

10. The ventilator illumination device according to claim 1, wherein the protruding lugs and the positioning element each extends from said one surface of the power box body.

* * * * *